US006457334B1

(12) United States Patent
Harker et al.

(10) Patent No.: US 6,457,334 B1
(45) Date of Patent: Oct. 1, 2002

(54) COVERING DEVICE FOR WASHERS AND DRYERS

(76) Inventors: Ann Harker, 20 Danehurst Close, Egham, Surrey (GB), TW209PX; Cameron Harker, 20 Danehurst Close, Egham, Surrey (GB), TW209PX ( * ) Notice: Subject to any disclaimer, the term of this patent is extended or adjusted under 35 U.S.C. 154(b) by 130 days.

(21) Appl. No.: 09/616,797

(22) Filed: Jul. 14, 2000

(51) Int. Cl.[7] ..... D06F 35/00; B65D 65/02
(52) U.S. Cl. ..... 68/3 R; 150/165
(58) Field of Search ..... 68/3 R; 150/165; 206/320; D6/610; D32/25

(56) References Cited

U.S. PATENT DOCUMENTS

| | | | | | |
|---|---|---|---|---|---|
| D119,513 | S | * | 3/1940 | Wolff | D6/610 |
| D240,882 | S | * | 8/1976 | Knight | D6/610 |
| D373,664 | S | * | 9/1996 | Jackson | D32/25 |
| D424,371 | S | * | 5/2000 | Delmonte | D6/610 |

* cited by examiner

*Primary Examiner*—Philip Coe
(74) *Attorney, Agent, or Firm*—Goldstein & Lavas, P.C.

(57) ABSTRACT

A covering device for washers and dryers including a washer cover dimensioned for covering the conventional clothes washer. The washer cover has a first removable access panel aligned with the door of the conventional washer whereby removal of the first removable access panel will allow the door to be fully opened and closed. The washer cover has a second removable access panel aligned with the control panel of the conventional washer whereby removal of the second removable access panel will allow access to the control panel for use. A dryer cover is dimensioned for covering the conventional clothes dryer. The dryer cover has a first removable access panel aligned with the door of the conventional dryer whereby removal of the first removable access panel will allow the door to be fully opened and closed. The dryer cover has a second removable access panel aligned with the control panel of the conventional dryer whereby removal of the second removable access panel will allow access to the control panel for use.

1 Claim, 1 Drawing Sheet

COVERING DEVICE FOR WASHERS AND DRYERS

BACKGROUND OF THE INVENTION

The present invention relates to a covering device for washers and dryers and more particularly pertains to protecting washers and dryers from being scratched and dented.

The use of protective covering devices is known in the prior art. More specifically, protective covering devices heretofore devised and utilized for the purpose of protecting items from being damaged are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,930,321 to Takahashi discloses a cover for a refrigerator unit, capable of allowing the sliding door to be opened and closed. U.S. Pat. No. 5,190,089 to Jackson discloses a protective bag for protecting an appliance, such as a washer or dryer, against water damage. U.S. Pat. No. 5,474,185 to Franke discloses a protective cover for an appliance for shipping.

While these devices fulfill their respective, particular objective and requirements, the aforementioned patents do not describe a covering device for washers and dryers for protecting washers and dryers from being scratched and dented.

In this respect, the covering device for washers and dryers according to the present invention substantially departs from the conventional concepts and designs of the prior art, and in doing so provides an apparatus primarily developed for the purpose of protecting washers and dryers from being scratched and dented.

Therefore, it can be appreciated that there exists a continuing need for a new and improved covering device for washers and dryers which can be used for protecting washers and dryers from being scratched and dented. In this regard, the present invention substantially fulfills this need.

SUMMARY OF THE INVENTION

In the view of the foregoing disadvantages inherent in the known types of protective covering devices now present in the prior art, the present invention provides an improved covering device for washers and dryers. As such, the general purpose of the present invention, which will be described subsequently in greater detail, is to provide a new and improved covering device for washers and dryers which has all the advantages of the prior art and none of the disadvantages.

To attain this, the present invention essentially comprises a washer cover dimensioned for covering the conventional clothes washer. The washer cover has a first removable access panel aligned with the door of the conventional washer whereby removal of the first removable access panel will allow the door to be fully opened and closed. The washer cover has a second removable access panel aligned with the control panel of the conventional washer whereby removal of the second removable access panel will allow access to the control panel for use. A dryer cover is dimensioned for covering the conventional clothes dryer. The dryer cover has a first removable access panel aligned with the door of the conventional dryer whereby removal of the first removable access panel will allow the door to be fully opened and closed. The dryer cover has a second removable access panel aligned with the control panel of the conventional dryer whereby removal of the second removable access panel will allow access to the control panel for use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved covering device for washers and dryers which has all the advantages of the prior art protective covering devices and none of the disadvantages.

It is another object of the present invention to provide a new and improved covering device for washers and dryers which may be easily and efficiently manufactured and marketed.

It is a further object of the present invention to provide a new and improved covering device for washers and dryers which is of durable and reliable construction.

An even further object of the present invention is to provide a new and improved covering device for washers and dryers which is susceptible of a low cost of manufacture with regard to both materials and labor, and which accordingly is then susceptible of low prices of sale to the consuming public, thereby making such a covering device for washers and dryers economically available to the buying public.

Even still another object of the present invention is to provide a new and improved covering device for washers and dryers for protecting washers and dryers from being scratched and dented.

Lastly, it is an object of the present invention to provide a new and improved covering device for washers and dryers including a washer cover dimensioned for covering the conventional clothes washer. The washer cover has a first removable access panel aligned with the door of the conventional washer whereby removal of the first removable access panel will allow the door to be fully opened and closed. The washer cover has a second removable access panel aligned with the control panel of the conventional washer whereby removal of the second removable access panel will allow access to the control panel for use. A dryer cover is dimensioned for covering the conventional clothes dryer. The dryer cover has a first removable access panel aligned with the door of the conventional dryer whereby removal of the first removable access panel will allow the door to be fully opened and closed. The dryer cover has a second removable access panel aligned with the control panel of the conventional dryer whereby removal of the second removable access panel will allow access to the control panel for use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
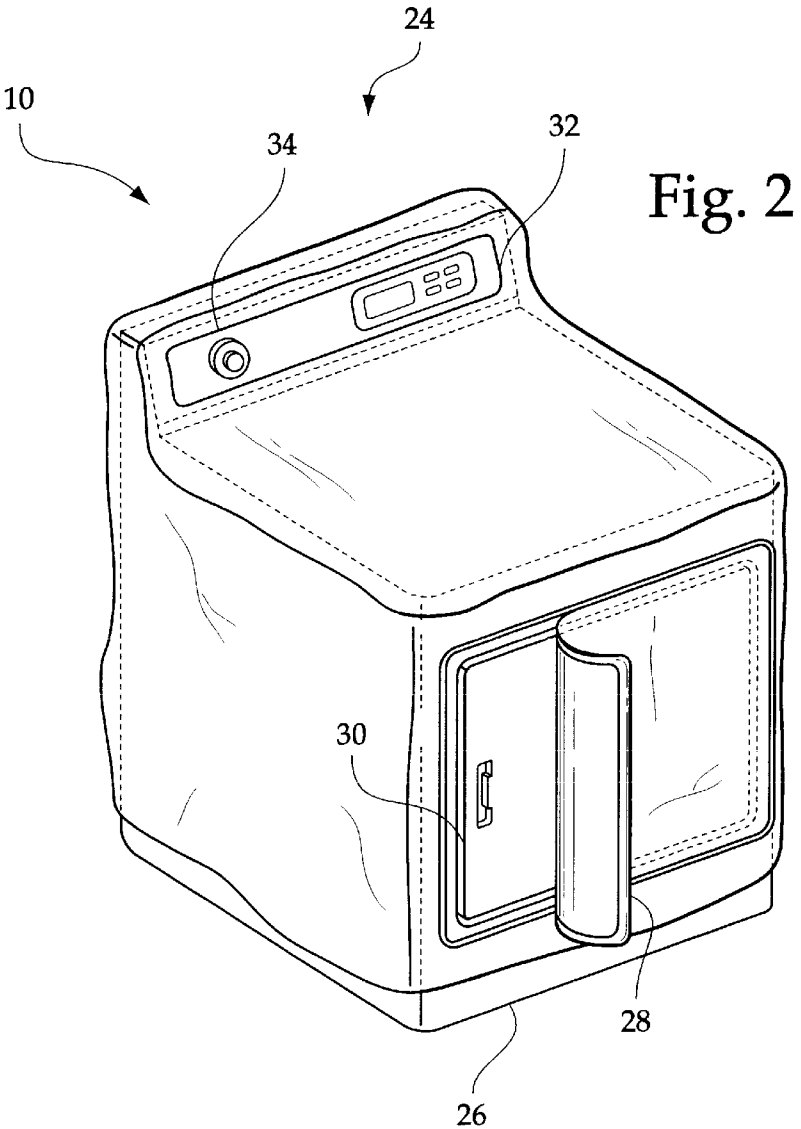
FIG. 2 is a perspective view of the present invention shown in use of a conventional clothes dryer.
Figure 1:
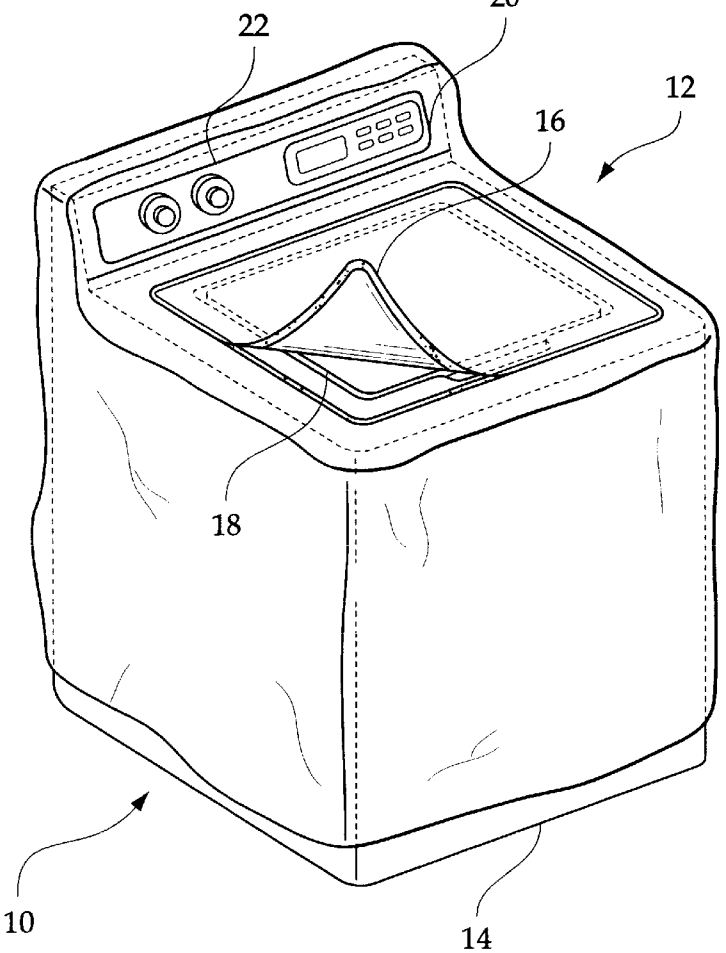
FIG. 1 is a perspective view of the preferred embodiment of the covering device for a conventional clothes washer constructed in accordance with the principles of the present invention.

With reference now to the drawings, and in particular, to FIGS. 1 and 2 thereof, the preferred embodiment of the new and improved covering device for washers and dryers embodying the principles and concepts of the present invention and generally designated by the reference number 10 will be described.

Specifically, it will be noted in the various Figures that the device relates to a covering device for washers and dryers for protecting washers and dryers from being scratched and dented. In its broadest context, the device consists of a washer cover and a dryer cover. Such components are individually configured and correlated with respect to each other so as to attain the desired objective.

The washer cover 12 is dimensioned for covering the conventional clothes washer 14. Note FIG. 1. The washer cover 12 has a first removable access panel 16 aligned with the door 18 of the conventional washer 14 whereby removal of the first removable access panel 16 will allow the door 18 to be fully opened and closed. The washer cover 12 has a second removable access panel 20 aligned with the control panel 22 of the conventional washer 14 whereby removal of the second removable access panel 20 will allow access to the control panel 22 for use.

The dryer cover 24 is dimensioned for covering the conventional clothes dryer 26. Note FIG. 2. The dryer cover 24 has a first removable access panel 28 aligned with the door 30 of the conventional dryer 26 whereby removal of the first removable access panel 28 will allow the door 30 to be fully opened and closed. The dryer cover 24 has a second removable access panel 32 aligned with the control panel 34 of the conventional dryer 24 whereby removal of the second removable access panel 32 will allow access to the control panel 34 for use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A covering device for washers and dryers for protecting conventional clothes washers and conventional clothes dryers from being scratched and dented, the washers and dryers each including doors for loading and unloading clothes and control panels for controlling operative functions of the respective washer and dryer, the covering device comprising, in combination:

a washer cover dimensioned for covering the conventional clothes washer, the washer cover having a first removable access panel aligned with the door of the conventional washer whereby removal of the first removable access panel will allow the door to be fully opened and closed, the washer cover having a second removable access panel aligned with the control panel of the conventional washer whereby removal of the second removable access panel will allow access to the control panel for use;

a dryer cover dimensioned for covering the conventional clothes dryer, the dryer cover having a first removable access panel aligned with the door of the conventional dryer whereby removal of the first removable access panel will allow the door to be fully opened and closed, the dryer cover having a second removable access panel aligned with the control panel of the conventional dryer whereby removal of the second removable access panel will allow access to the control panel for use.

* * * * *